US006325060B1

(12) United States Patent
Okura et al.

(10) Patent No.: US 6,325,060 B1
(45) Date of Patent: Dec. 4, 2001

(54) STACK-EQUIPPED FAR INFRARED SPACE HEATER

(75) Inventors: Michitaka Okura; Tomonori Miyajima, both of Aichi-ken (JP)

(73) Assignee: Toyotomi Co. Ltd., Aichi-ken (JP)

( * ) Notice: Subject to any disclaimer, the term of this patent is extended or adjusted under 35 U.S.C. 154(b) by 0 days.

(21) Appl. No.: 09/624,766

(22) Filed: Jul. 25, 2000

(51) Int. Cl.[7] ..... F24H 3/08

(52) U.S. Cl. ..... 126/94; 126/95; 126/91 R; 126/91 A

(58) Field of Search ..... 126/95, 91 R, 126/91 A, 93, 94, 85 R, 201, 84, 92 C, 85 B, 110 B, 110 D, 116 R, 114; 122/182.2, 182.3, 155.2, 156; 165/72, 75

(56) References Cited

U.S. PATENT DOCUMENTS

| | | | | |
|---|---|---|---|---|
| 1,255,033 | * | 1/1918 | McNutt | 126/201 |
| 2,737,173 | * | 3/1956 | Huack et al. | 126/110 B |
| 3,980,069 | * | 9/1976 | Butlak et al. | 126/91 A |

FOREIGN PATENT DOCUMENTS

| | | | | |
|---|---|---|---|---|
| 53-071328 | * | 6/1978 | (JP) | 126/110 C |
| 62-26453 | * | 2/1987 | (JP) | 126/110 C |
| 63-4085 | | 1/1988 | (JP) . | |
| 03-236517 | * | 10/1991 | (JP) | 126/512 |
| 10-281558 | | 10/1998 | (JP) . | |
| 11-037562 | | 2/1999 | (JP) . | |

* cited by examiner

*Primary Examiner*—Carl D. Price
(74) *Attorney, Agent, or Firm*—Connolly Bove Lodge & Hutz, LLP

(57) ABSTRACT

A stack-equipped far infrared space heater capable of permitting a space of a relatively large volume through which hot air for fan forced space heating fails to carry well to be satisfactorily heated by far infrared rays. The space heater includes a combustion cylinder mounted on a burner arranged in a housing, a plurality of heat-exchange pipes arranged on the combustion cylinder, and a cylindrical exhaust structure arranged on the heat-exchange pipes. A guard is arranged on the housing so as to surround the combustion cylinder and cylindrical exhaust structure and mounted thereon with a top plate, which is formed at a central portion thereof with an opening. An upper wall of the cylindrical exhaust structure is fitted in the opening and securely fixed to the top plate through fixtures. A stack is connected to a side wall of the cylindrical exhaust structure so as to upwardly extend therefrom through a bent cylinder. The parts or components extending from the combustion cylinder to the stack are constructed integrally with each other to exhaust combustion gas by drafting force in the stack.

4 Claims, 3 Drawing Sheets

STACK-EQUIPPED FAR INFRARED SPACE HEATER

BACKGROUND OF THE INVENTION

This invention relates to a stack-equipped far infrared space heater, and more particularly to a stack-equipped far infrared space heater suitable for heating a space of a relatively large volume through which hot air for fan forced space heating fails to carry well.

There has been conventionally known an oil-fired space heater in the art which is constructed in such a manner that a combustion chamber is constructed so as to extend from an upper portion of a burner arranged in a housing toward an upper portion of the housing. Now, such a conventional oil-fired space heater will be described with reference to FIG. 3. The space heater includes a burner 110 arranged in a housing 112 and a combustion cylinder 114 mounted on the housing 112 so as to define a combustion chamber 116 therein. The combustion chamber 116 is formed so as to communicate with the burner 110. The space heater also includes a guard 118 mounted on the housing 112 so as to surround the combustion cylinder 114. The guard 118 is mounted on an upper end thereof with a top plate 120, which cooperates with the guard 118 to cover the combustion cylinder 114. The combustion cylinder 114 is mounted on an upper end thereof with an upper plate 122.

The space heater further includes a convection fan 124 arranged between the upper plate 122 of the combustion cylinder 114 and the top plate 120 of the guard 118 so as to carry out convention of ambient air or air in a room in which the space heater is placed. Thus, the convection fan 124 functions to blow ambient air against the upper plate 122 of the combustion cylinder 114, to form an air stream in a whole circumferential direction of the space heater. The combustion cylinder 114 is formed with slit-like elongated holes or through-holes, which permit combustion gas in the combustion chamber 116 to be discharged therethrough to an outside of the combustion cylinder 116. In this instance, the above-described air stream formed by the convection fan 124 prevents upward flowing of the thus-discharged combustion gas, resulting in the combustion gas being forcibly directed outwardly in the whole circumferential direction of the combustion cylinder 114 while being kept hot.

The combustion cylinder 114 is provided therein with a red-heated element 126 in a manner to be suspended from the upper plate 122 of the combustion cylinder 114. The red-heated element 126 is red-heated by combustion heat generated from the burner 110, to thereby outwardly discharge heat rays via the above-described through-holes of the combustion cylinder 114.

In FIG. 3, reference numerals 128, 130 and 132 designate a combustion fan, a fuel pump and an atomizing nozzle, respectively.

The conventional oil-fired space heater thus constructed is adapted to be placed at a central region in a space to be heated unlike a fan forced space heater including a convection fan arranged on a rear side of a housing, so that many people may warm themselves while gathering about the heater.

Space heating by such a conventional oil-fired space heater is mainly attained by hot air heated by combustion in the burner; because most of heat rays radiated from the red-heated element 126 other than heat rays permeating via the through-holes of the combustion cylinder 114 are blocked by the combustion cylinder 114, so that heat rays emitted from the element 126 fail to significantly contribute to space heating contrary to expectation. Also, hot air discharged outwardly in all directions from the combustion cylinder 114 is rapidly reduced in flow velocity with an increase in distance from the combustion cylinder 114. Thus, the conventional oil-fired spaced heater is unsuitable for heating a space substantially open or a space of a large volume.

Further, a solid fuel stove in which coal or wood is used as fuel therefor and an upright pot-type stove in which kerosine is used as fuel therefor have been conventionally used for space heating. The stoves each include a stack mounted on a side wall of a combustion cylinder and arranged so as to extend to an exterior of a room in which it is placed. Combustion gas is guided from the stove through the stack to the exterior.

However, the conventional stoves described above fail to increase a heat discharge area due to its structural restriction. Also, they cause combustion gas to be exhausted to the exterior while keeping a temperature of the exhausted combustion gas high, leading to a deterioration in heating efficiency. Further, they continue to discharge incomplete combustion gas for a period of time before combustion is rendered stable after ignition, resulting in discharge of the combustion gas to the exterior through the stack being unavoidable.

A burner which has been recently developed is constructed into a structure of the rotary atomizing type, the pressure spraying type or the like, to thereby ensure stable combustion right after ignition of the burner, resulting in substantially preventing discharge of bad odor and generation of incomplete combustion gas to a room even when combustion gas is exhausted to the room. This permits a fan forced space heater to be put into practice which is so constructed that a combustion cylinder is configured into a porous structure while incorporating such a burner in the space heater, resulting in ensuring heat radiation from a red-heated element and discharge of hot air in all directions from the combustion cylinder. Nevertheless, the fan forced space heater is suitable only for heating a space of a limited size or volume. Also, it fails to ensure satisfactory heating in a drafty space or a substantially open space.

Further, there has been conventionally proposed a space heater which is adapted to be set at a central portion of a space and includes a stack. Unfortunately, the space heater has a heat dissipation region defined on only an outer surface of a combustion cylinder, to thereby fail to provide a sufficient heat dissipation area, leading to a reduction in heating capacity. In order to address the problem, it is required that a burner increased in heat generation is incorporated in the space heater. This leads to a large-sizing of the space heater and an increase in manufacturing cost thereof.

Thus, it would be highly desirable to develop a space heater which is capable of providing satisfactory heating in a large space such as a factory, a large-sized tent or the like.

SUMMARY OF THE INVENTION

The present invention has been made in view of the foregoing disadvantage of the prior art.

Accordingly, it is an object of the present invention to provide a stack-equipped far infrared space heater which is capable of ensuring efficient space heating of a large space such as a warehouse, a factory or the like which has a high ceiling and is drafty.

In accordance with the present invention, a stack-equipped far infrared space heater is provided. The stack-equipped far infrared space heater includes a housing, a burner arranged in the housing, a combustion cylinder arranged on the housing so as to upwardly extend therefrom and formed therein with a combustion chamber of a cylindrical shape in a manner to communicate with the burner, a guard mounted on the housing so as to upwardly extend therefrom and surround the combustion cylinder, and a top plate mounted on an upper end of the guard and cooperating with the guard to cover the combustion cylinder. The combustion cylinder has a side wall and an upper plate mounted on an upper end of the side wall. The side wall of the combustion cylinder is free from any hole which causes the combustion chamber to communicate with an exterior of the combustion cylinder therethrough. The space heater also includes a plurality of heat-exchange pipes mounted on the upper plate of the combustion cylinder so as to upwardly extend therefrom and a cylindrical exhaust structure arranged on the heat-exchange pipes and constructed so as to define an exhaust gas chamber therein in a manner to communicate with the heat-exchange pipes. The cylindrical exhaust structure includes an upper wall and a side wall. The top plate of the guide is formed at a central portion thereof with an opening. The upper wall of the cylindrical exhaust structure is fitted in the opening of the top plate. The space heater further includes a connection cylinder mounted on the side wall of the cylindrical exhaust structure so as to communicate with the exhaust gas chamber and a stack connected through the connection cylinder to the cylindrical exhaust structure in a manner to communicate with the exhaust gas chamber. The stack is arranged so as to extend through a portion of the guard positioned below the top plate of the guard. Thus, far infrared rays are radiated from the combustion cylinder, the heat-exchange pipes and the wide wall of the exhaust structure to an exterior of the space heater.

In a preferred embodiment of the present invention, the stack has a bent cylinder provided on a lower portion thereof, through which the stack is securely connected to the connection cylinder. The stack is provided therein with an exhaust control means for controlling exhaust of combustion gas. The stack, bent cylinder, cylindrical exhaust structure, heat-exchange pipes and combustion cylinder each are coated on an outer surface thereof with a far infrared radiation paint. Such construction permits the cylindrical exhaust structure to constitute a significant portion of a heat dissipation area of the space heater, to thereby enhance heating efficiency.

In a preferred embodiment of the present invention, the opening of the top plate of the guard is formed into a diameter larger than an outer diameter of the cylindrical exhaust structure. The upper wall of the cylindrical exhaust structure is positioned above the opening of the top plate. Also, a plurality of fixtures are arranged so as to extend from the cylindrical exhaust structure to the top plate. The fixtures are fixed to the top plate so as to define a gap between a periphery of the opening of the top plate and the side wall of the cylindrical exhaust structure. Such construction permits the gap to promote heat dissipation from the exhaust gas chamber when air in a room rises through the gap. Also, the above-described construction causes the space heater to be increased in height as compared with the conventional space heater. However, the cylindrical exhaust structure is securely supported by the top plate of the guard through the fixtures, resulting in the space heater being highly stable.

In a preferred embodiment of the present invention, the burner is provided with a combustion fan for forcibly feeding combustion air to the burner. The combustion fan is provided on a suction side thereof with an air filter. The space heater has a gas flow passage defined therein so as to be extend from the air filter to the stack. The gas flow passage is free from an access port which causes ambient air to enter an interior of the space heater therethrough or combustion gas to be discharged to an exterior of the space heater therethrough, so that combustion gas may be exhausted by air blowing force of the combustion fan and drafting force generating in the stack. Thus, the space heater of the present invention attains stable combustion operation even in a dusty space such as a factory or the like.

Thus, the space heater of the present invention is particularly suitable for use in a drafty space of a large volume such as a high-ceiled warehouse, a high-ceiled factory or the like. The burner arranged in the housing is provided thereon with the combustion cylinder, heat-exchange pipes and cylindrical exhaust structure in a manner to be vertically stacked on each other in order. Also, the stack is securely connected to the side wall of the cylindrical exhaust structure so as to vertically extend therefrom. Such construction permits combustion gas to be efficiently exhausted by drafting force generated in the stack even when the heat-exchange pipes and exhaust gas chamber each are formed into a large volume. This permits an area of the parts contacted with combustion gas during passage of combustion gas through the space heater to be increased, resulting in a heat dissipation area of the space heater being highly increased, so that far infrared rays may be efficiently radiated from the space heater.

The parts or components of the heat spacer extending from the combustion cylinder to the stack which carry out heat dissipation are vertically stacked on each other, so that the space heater may be placed at a central portion in a room to be space-heated as in the conventional solid fuel stove. Such arrangement causes the space heater to be increased in height, to thereby possibly deteriorate stability of the space heater. However, in the present invention, the guard is arranged so as to extend from the housing to a level of the cylindrical exhaust structure and the cylindrical exhaust structure is fixed to the top plate of the guard through the fixture. This results in the space heater being significantly stable.

Further, the combustion fan for feeding combustion air to the burner is mounted on the suction side thereof with the air filter, to thereby prevent leakage of combustion gas from space heater and intrusion of dusty air into the space heater in the gas flow passage defined between the combustion fan and the stack. This minimizes incomplete combustion in the space heater and pollution of the gas flow passage, to thereby ensure efficient radiation of far infrared rays.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1:
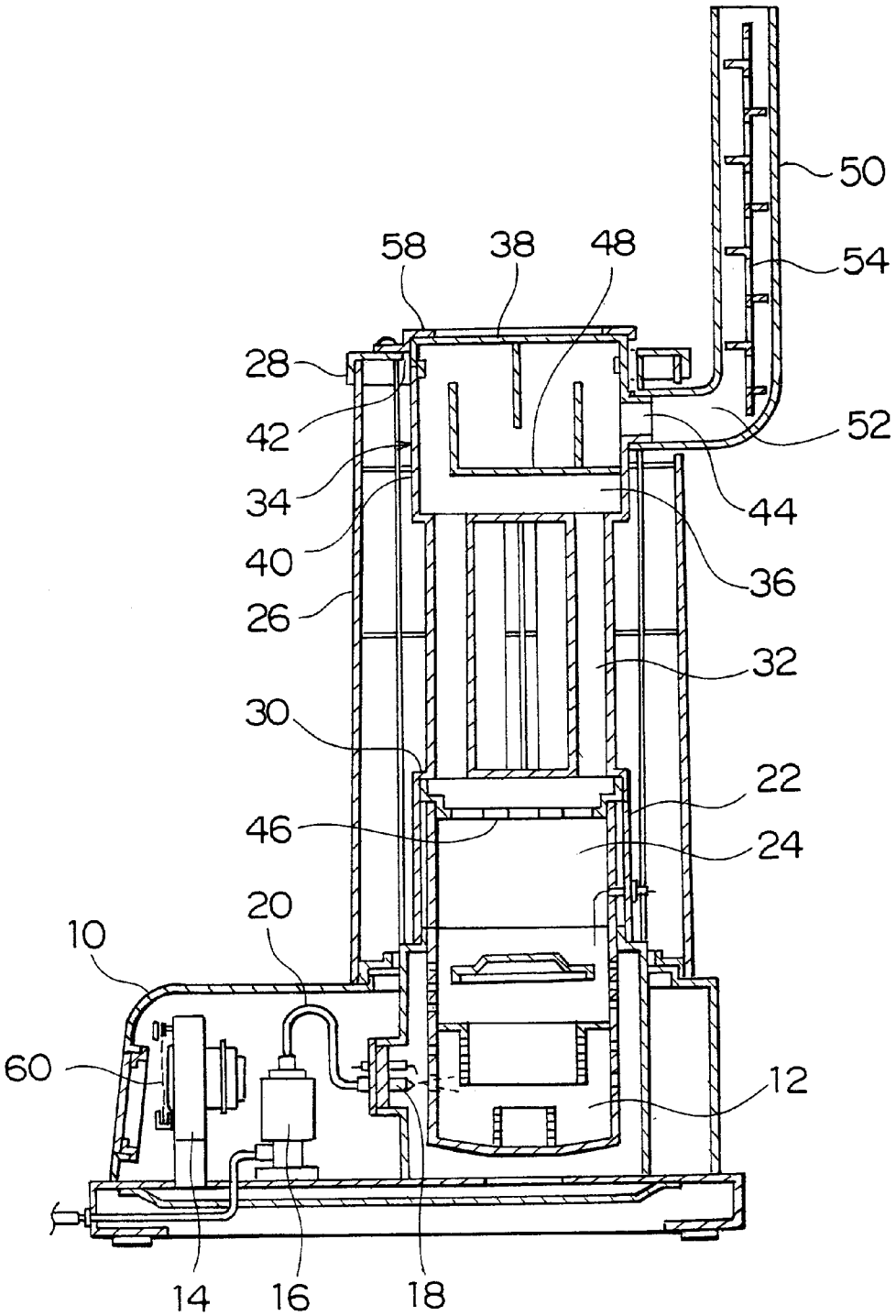
FIG. 1 is a vertical sectional view showing an essential part of an embodiment of a stack-equipped far infrared space heater according to the present invention.
Figure 2:
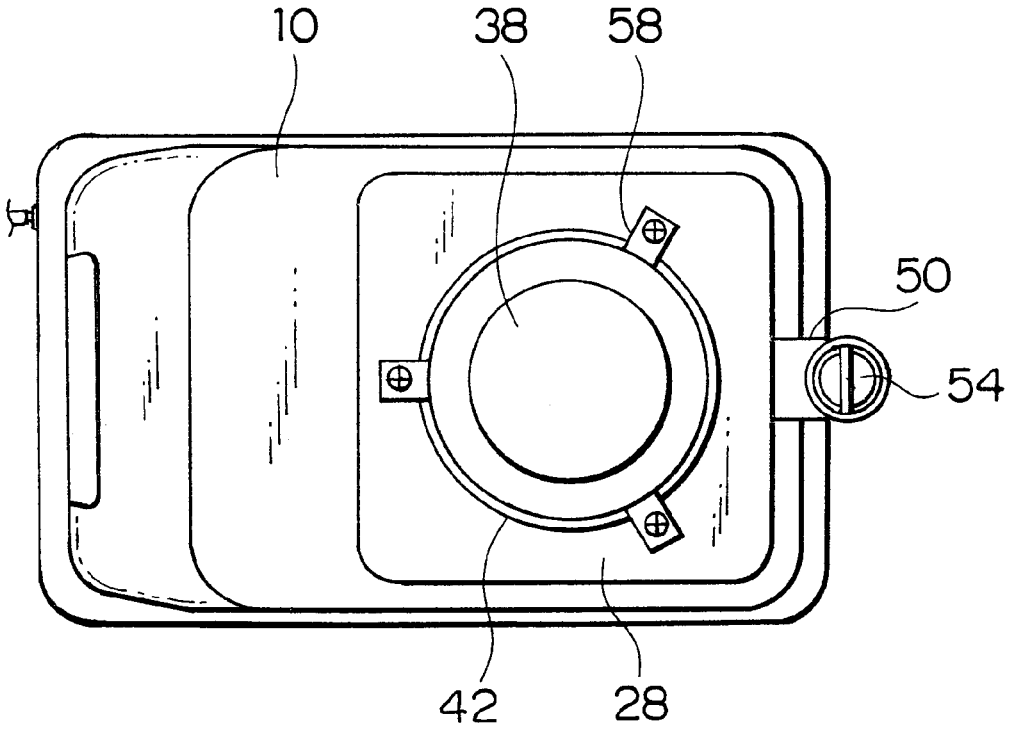
FIG. 2 is a plan view of the stack-equipped far infrared space heater shown in FIG. 1.
Figure 3:
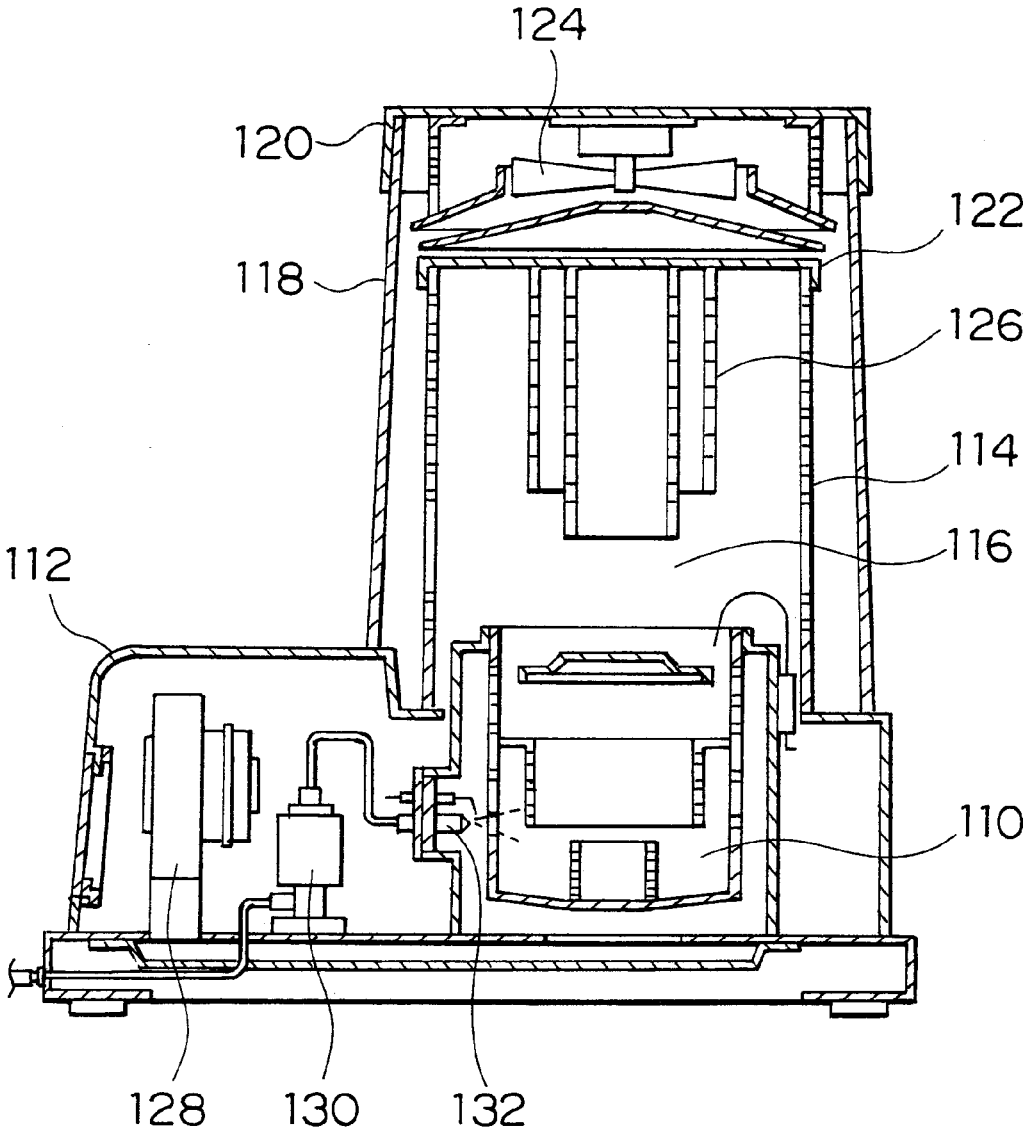
FIG. 3 PRIOR ART
FIG. 3 is a vertical sectional view showing an essential part of a conventional fan forced space heater.

Now, a stack-equipped far infrared space heater according to the present invention will be described with reference to FIGS. 1 and 2. A stack-equipped far infrared space heater of the illustrated embodiment includes a housing 10 and a burner 12 arranged in the housing 10. The space heater also includes a combustion fan 14 for feeding combustion air to the burner 12 and a fuel pump 16 for pumping fuel toward the burner 12 under pressure. The fuel pump 16 has an atomizing nozzle 18 connected thereto through a fuel feed pipe 20 so as to feed fuel to the burner 12 while atomizing it. Thus, fuel is guided from an fuel tank (not shown) to the fuel pump 16, which feeds fuel to the atomizing nozzle 18 under pressure. Then, the atomizing nozzle 18 injects fuel into the burner 12 while atomizing it. Concurrently, the combustion fan 14 feeds the burner 12 with combustion air. Then, the atomized fuel is ignited, so that the burner 12 may immediately carry out stable combustion.

The stack-equipped far infrared space heater of the illustrated embodiment also includes a combustion cylinder 22 arranged on the burner 12 so as to upwardly extend therefrom and formed therein with a combustion chamber 24 of a cylindrical shape in a manner to communicate with the burner 12, a guard 26 mounted on the housing 10 so as to upwardly extend therefrom and surround the combustion cylinder 22, and a top plate 28 mounted on an upper end of the guard 26 and cooperating with the guard 26 to cover the combustion cylinder 22. The combustion cylinder 22 includes a side wall free from any hole which causes the combustion chamber 24 to communicate with an exterior of the combustion cylinder 22. The space heater further includes an upper plate 30 mounted on an upper end of the combustion cylinder 22, a plurality of heat-exchange pipes 32 mounted on the upper plate 30 of the combustion cylinder 22 so as to upwardly extend therefrom, and a cylindrical exhaust structure 34 arranged on the heat-exchange pipes 32 in a manner to communicate with the heat-exchange pipes 32 and constructed so as to define an exhaust gas chamber 36 therein. The cylindrical exhaust structure 34 includes an upper wall 38 and a side wall 40. The top plate 28 of the guard 26 is formed at a central portion thereof with an opening 42. The upper wall 38 of the cylindrical exhaust structure 34 is fitted in the opening 42 of the top plate 28. Thus, it will be noted that the guard 26 is arranged so as to surround the heat-exchange pipes 32 and cylindrical exhaust structure 34 as well as the combustion cylinder 22.

The stack-equipped far infrared space heater also includes a connection cylinder 44 mounted on the side wall 40 of the cylindrical exhaust structure 34 so as to communicate with the exhaust gas chamber 36. The cylindrical exhaust structure 34 may be constructed into substantially the same outer configuration as the combustion cylinder 22 except that both are different in length. Thus, the structure 34 and cylinder 22 may be constituted by parts substantially common to both.

The combustion cylinder 22 is provided therein with a combustion gas guide plate 46 so as to be positioned in the combustion chamber 24. The combustion gas guide plate 46 functions to facilitate flowing of combustion gas from the combustion chamber 24 to the heat-exchange pipes 32 and heat insulation of a side surface of the combustion cylinder 22 and the upper plate 30.

The exhaust gas chamber 36 is provided therein with a partition 48 for guiding combustion gas fed from the heat-exchange pipes 32 to the exhaust gas chamber 36 to the connection cylinder 44. The partition 48 functions to permit the combustion gas to be efficiently flowed in proximity to an inner surface of the cylindrical exhaust structure 34, to thereby increase a temperature of the side wall 40 of the cylindrical exhaust structure 34. Thus, the space heater of the illustrated embodiment permits heat dissipation to be carried out on an outer surface of each of the heat-exchange pipes 32 and cylindrical exhaust structure 34 as well as an outer surface of the combustion cylinder 22, leading to an increase in heat dissipation area. Also, the outer surface of the combustion cylinder 22 is reduced in temperature by an action of the combustion gas guide plate 46, whereas the outer surface of the cylindrical exhaust structure 34 is increased in temperature by an action of the partition 48. Further, the outer surfaces each may be coated thereon with a far infrared radiation paint as required, to thereby efficiently radiate far infrared rays therefrom, so that space heating may be effectively carried out without depending on only hot air.

In the illustrated embodiment, a means for forcibly exhausting or discharging combustion gas is constituted by only the combustion fan 14. Thus, a mere increase in heat dissipation area causes an increase in flow resistance of the combustion gas, to thereby restrain smooth exhaust of the combustion gas from the space heater, leading to a possibility of abnormal combustion. This causes the combustion cylinder 22 or combustion chamber 24, the heat-exchange pipes 32 and the cylindrical exhaust structure 34 or exhaust gas chamber 36 to be subject to restriction on size. Thus, an increase in heat radiation area of the space heater is limited within a range which ensures complete combustion in the burner 12. Therefore, the prior art fails to permit heat dissipation by far infrared rays to be significantly substituted for heat dissipation by hot air unless the burner is improved so as to substantially enhance forced draft to a degree sufficient to ensure complete combustion. The stack-equipped far infrared space heater of the illustrated embodiment is constructed so as to address the problem of the prior art.

More particularly, the space heater of the illustrated embodiment includes a stack 50 connected at a lower end thereof to the connection cylinder 44 of the cylindrical exhaust structure 34 and arranged so as to upwardly extend through a portion of the guard 26 positioned below the top plate 28 of the guard 26. In the illustrated embodiment, the stack 50 is connected to the connection cylinder 44 through a bent cylinder 52 which is bent into an elbow-like shape and securely connected to the lower end of the stack 50. The bent cylinder 52 may be formed integrally with the stack 50. The stack 50 is provided therein with an exhaust control means 54 in a manner to vertically extend therein. The exhaust control means 54 functions to guide combustion gas so as to permit it to be flowed in proximity to an inner surface of the stack 50 as in the partition 48 in the exhaust gas chamber 36. The stack 50 and bent cylinder 52 may be coated thereon with a far infrared radiation paint as required.

The stack 50 thus connected through the bent cylinder 52 to the connection cylinder 44 permits draft to generated therein in spite of the fact that the exhaust control means 54 is arranged therein, so that combustion gas staying in the exhaust gas chamber 36 may be effectively outwardly exhausted through the stack 50 by suction due to the draft. Such construction permits combustion gas to be outwardly smoothly exhausted without constructing the burner 12 into any specific structure. Also, it permits a height of the cylindrical exhaust structure 34 and a length of the heat-exchange pipes 6 to be increased to a degree sufficient to increase a heat dissipation area of the space heater. Further, the stack 50 is heated on an outer surface thereof to an elevated temperature sufficient to permit the stack to radiate far infrared rays, to thereby contribute to an increase in heating efficiency by far infrared rays.

The top plate 28 of the guard 26 is formed at a central portion thereof with the above-described opening 42. The opening 42 is formed into a size larger than an outer diameter of the cylindrical exhaust structure 34, so that the upper wall 38 of the cylindrical exhaust structure 34 may be upwardly projected at an upper portion thereof through the opening 42 of the top plate 28. This keeps the top plate 28 of the guard 26 from overlying the exhaust gas chamber 36 and permits an annular gap for air passage to be defined between the cylindrical exhaust structure 34 and the top plate 28, resulting in preventing direct heat transmission from the cylindrical exhaust structure 34 to the top plate 28 of the guard 26. Thus, even when the cylindrical exhaust structure 34 or exhaust gas chamber 36 is heated to an elevated temperature, air upwardly flowing through the gap between the cylindrical exhaust structure 34 and the top plate 28 cools the top plate 28, to thereby keep a periphery of the top plate 28 of the guard 26 which a user or operator apt to touch by mistake at a relatively low temperature. This minimizes occurrence of any accident such as a burn or the like due to such inadvertent touch with the top plate 28.

The upper wall 38 of the cylindrical exhaust structure 34 is securely attached to the top plate 28 of the guard 26 by means of a plurality of fixtures 58 arranged so as to extend from the upper wall 38 of the cylindrical exhaust structure 34 to the top plate 28 of the guard 26. Such construction ensures that the cylindrical exhaust structure 34 is stably supported in spite of the fact that the combustion cylinder 22, heat-exchange pipes 32 and cylindrical exhaust structure 34 are arranged in order on the burner 12 so as to upwardly extend therefrom, resulting in the space heater being increased in height.

The combustion fan 14 is provided on a suction side thereof with an air filter 60. Another feature of the illustrated embodiment is that an access port which causes ambient air or air in a room in which the space heater is placed to enter an interior of the space heater therethrough or combustion gas to get out of the space heater therethrough is kept from being arranged in a gas flow passage defined so as to extend from the air filter 60 to an outlet of the stack 50 in the space heater. Such construction prevents intrusion of dust into the burner 12 from the exterior of the space heater, to thereby eliminate abnormal combustion in the burner due to catching of the dust in the burner. Also, it prevents intrusion of dusty air into the space heater even when draft in the stack 9 renders a pressure in the exhaust gas chamber 36 negative. This ensures stable operation of the space heater even in a dusty place.

Further, the stack 50 is arranged so as to exhibit both a space heating function and a function of exhausting combustion gas by suction or drafting. Thus, operation of the stack-equipped far infrared space heater of the illustrated embodiment in a large or open space such as a factory is basically carried out in such a manner that combustion gas is exhausted from the stack 50 to the space. Whereas, when the space heater is operated in an airtight room, the stack 50 has an extension (not shown) connected to a distal end thereof, to thereby be guided to an exterior of the room. In this instance, it is operated in the form of an outdoor exhaust type space heater. Thus, the space heater of the illustrated embodiment may be operated in a manner selected depending on a place in which the space heater is put.

As described above, the conventional space heater is substantially the fan forced type which is adapted to be operated in a closed room, resulting in being unsuitable for use in a drafty or open space of a large volume such as a factory or the like. The present invention is constructed so as to be suitable for far infrared space heating by heat rays radiated to a distance rather than fan forced space heating by hot air, resulting in being effectively operated in a large drafty space while being positioned at a central region in the space.

Also, the stack-equipped far infrared space heater of the present invention ensures space heating at enhanced efficiency while incorporating the burner constructed like that conventionally used for fan forced space heating therein. For this purpose, the present invention employs novel arrangement of parts extending the combustion cylinder to the stack, to thereby effectively provide far infrared space heating in place of fan forces space heating conventionally employed.

Further, the space heater of the present invention is constructed so that a height thereof is increased to increase a heat dissipation area or far infrared ray radiating area. Also, a reduction in exhaust capacity due to such an increase in heat dissipation area is compensated by arrangement of the cylindrical exhaust structure. Such configuration would possibly cause the space heater to be unstable. In order to solve the problem, the present invention is so constructed that the guard is arranged outside the combustion cylinder so as to vertically extend from the housing to the cylindrical exhaust structure, the cylindrical exhaust structure is exposed at an upper portion thereof through the opening of the top plate of the guard, and the cylindrical exhaust structure is securely connected to the top plate by means of the fixtures. Such construction leads to an increase in stability of the space heater to a degree sufficient to permit a kettle or the like to be safely and stably put on the upper wall of the cylindrical exhaust structure.

Moreover, such a far infrared space heater is apt to be used in a dusty hard environment unlike a fan forced space heater, so that a countermeasure thereto is important. In this regard, the present invention is so constructed that the combustion fan for feeding combustion air to the burner is provided on the suction side thereof with the air filter to prevent dusty air from entering the space heater through an air passage extending from the combustion fan to the burner. Also, in the present invention, the access port which causes ambient air or air in a room in which the space heater is placed to be accessed to the interior of the space heater is kept from being arranged in the gas flow passage defined so as to extend from the air filter to the outlet of the stack in the space heater. Such configuration ensures stable operation of the space heater by merely confirming a state of the air filter.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A stack-equipped infrared space heater comprising:

a housing;

a burner arranged in said housing;

a combustion cylinder arranged on said housing so as to extend upwardly and formed therein with a combustion chamber of a cylindrical shape in a manner to communicate with said burner;

a guard mounted on said housing so as to extend upwardly and surround said combustion cylinder;

a top plate mounted on an upper end of said guard and cooperating with said guard to cover said combustion cylinder;

said combustion cylinder having a side wall and an upper plate mounted on an upper end of said side wall;

said side wall being free from any hole which causes said combustion chamber to communicate with an exterior of said combustion cylinder therethrough;

a plurality of heat-exchange pipes mounted on said upper plate of said combustion cylinder so as to upwardly extend therefrom;

a cylindrical exhaust structure arranged on said heat-exchange pipes providing an exhaust gas chamber to communicate with said heat-exchange pipes;

said cylindrical exhaust structure including an upper wall and a side wall;

said top plate of said guide having a central portion thereof with an opening;

said upper wall of said cylindrical exhaust structure being fitted in said opening of said top plate;

a connection cylinder mounted on said side wall of said cylindrical exhaust structure so as to communicate with said exhaust gas chamber; and a stack connected through said connection cylinder to said cylindrical exhaust structure in a manner to communicate with said exhaust gas chamber;

said stack being arranged so as to extend through a portion of said guard positioned below said top plate of said guard;

whereby far infrared rays are radiated from said combustion cylinder, said heat-exchange pipes and said side wall of said exhaust structure to an outside of the space heater.

2. A stack-equipped far infrared space heater as defined in claim 1, wherein said stack has a bent cylinder provided on a lower portion through which said stack is securely connected to said connection cylinder;

said stack is provided with an exhaust control means for controlling exhaust of combustion gas; and said stack, bent cylinder, cylindrical exhaust structure, heat-exchange pipes and combustion cylinder each are coated on an outer surface thereof with a far infrared radiation paint.

3. A stack-equipped far infrared space heater as defined in claim 1, wherein said opening of said top plate of said guard is formed into a diameter larger than an outer diameter of said cylindrical exhaust structure;

said upper wall of said cylindrical exhaust structure is positioned above said opening of said top plate; and a plurality of fixtures are arranged so as to extend from said cylindrical exhaust structure to said top plate;

said fixtures being fixed to said top plate so as to define a gap between a periphery of said opening of said top plate and said side wall of said cylindrical exhaust structure.

4. A stack-equipped far infrared space heater as defined in claim 1, wherein said burner is provided with a combustion fan for forcibly feeding combustion air to said burner;

said combustion fan being provided on a suction side with an air filter;

a gas flow passage being defined so as to extend from said air filter to said stack;

said gas flow passage being free from an access port which causes ambient air to be accessed to an interior of the space heater, so that combustion gas may be exhausted by air blowing force of said combustion fan and draft in said stack.

* * * * *